US007094026B2

(12) United States Patent
Coign et al.

(10) Patent No.: US 7,094,026 B2
(45) Date of Patent: Aug. 22, 2006

(54) SYSTEM FOR SEALING AN INNER RETAINER SEGMENT AND SUPPORT RING IN A GAS TURBINE AND METHODS THEREFOR

(75) Inventors: Robert Walter Coign, Piedmont, SC (US); David John Humanchuk, Simpsonville, SC (US); Gregory Thomas Foster, Greer, SC (US); Kevin Lee Worley, Easley, SC (US)

(73) Assignee: General Electric Company, Schenectady, NY (US)

( * ) Notice: Subject to any disclaimer, the term of this patent is extended or adjusted under 35 U.S.C. 154(b) by 119 days.

(21) Appl. No.: 10/834,116

(22) Filed: Apr. 29, 2004

(65) Prior Publication Data

US 2005/0244267 A1 Nov. 3, 2005

(51) Int. Cl.
*F01D 9/04* (2006.01)

(52) U.S. Cl. ..... 415/189; 415/209.2; 415/209.3

(58) Field of Classification Search ..... 415/209.2, 415/209.3, 213.1, 189; 29/889.2
See application file for complete search history.

(56) References Cited

U.S. PATENT DOCUMENTS 5,149,250 A * 9/1992 Plemmons et al. ..... 415/209.3
5,224,822 A * 7/1993 Lenahan et al. ..... 415/189
6,537,023 B1 3/2003 Aksit et al.
6,568,903 B1 5/2003 Aksit et al.
6,572,331 B1 6/2003 Mohammed-Fakir et al.
6,595,745 B1 7/2003 Mohammed-Fakir et al.
6,599,089 B1 7/2003 Aksit et al.
6,609,885 B1 8/2003 Mohammed-Fakir et al.
6,609,886 B1 8/2003 Aksit et al.
6,637,751 B1 10/2003 Aksit et al.
6,637,752 B1 10/2003 Aksit et al.
6,637,753 B1 10/2003 Mohammed-Fakir et al.
6,641,144 B1 11/2003 Mohammed-Fakir et al.
6,648,333 B1 11/2003 Aksit et al.
6,659,472 B1 12/2003 Aksit et al.
6,719,295 B1 4/2004 Mohammed-Fakir et al.
6,752,592 B1 6/2004 Mohammed-Fakir et al.
6,764,081 B1 7/2004 Mohammed-Fakir et al.

* cited by examiner

*Primary Examiner*—Ninh H. Nguyen
(74) *Attorney, Agent, or Firm*—Nixon & Vanderhye, P.C.

(57) ABSTRACT

Arcuate seal layers conforming with one another are disposed between inner retainer segments and inner rails of nozzle segments of a gas turbine. The layers are secured to the aft axial face of the segments and project radially outwardly to seal against the forward axial faces of the rails. The rear axial faces of the rails have chordal seals for sealing against the forward axial faces of the support rings. The seal layers have radial cuts misaligned with one another in an axial direction to preclude leakage flows through gaps formed by the cuts. Arcuate spacers are staggered circumferentially with the arcuate retainer segments whereby an intermediate pressure plenum is formed between the finger seals and chordal seals.

13 Claims, 7 Drawing Sheets

SYSTEM FOR SEALING AN INNER RETAINER SEGMENT AND SUPPORT RING IN A GAS TURBINE AND METHODS THEREFOR

BACKGROUND AND SUMMARY OF THE INVENTION

The present invention relates to apparatus and methods for sealing between the inner retainer segment and an inner platform rail of a nozzle segment in a gas turbine and particularly relates to seal assemblies for increasing sealing and turbine engine efficiencies by reducing leakage between a high pressure region for supplying cooling air to the turbine nozzles and a forward rotor rim cavity including the hot gas path outboard of the rim cavity.

In gas turbines, hot gases of combustion flow from combustors through first stage nozzles and buckets and through follow-on stages. The first stage nozzles typically include an annular array or assemblage of cast nozzle segments each containing one or more nozzle stator vanes per segment. Each nozzle segment also includes inner and outer platforms or bands spaced radially one from the other. Upon assembly of the nozzle segments into the turbine, the stator vanes are circumferentially spaced from one another to form an annular array thereof between annular inner and outer platforms. The outer and inner platforms are secured to an outer casing and an inner support ring respectively. The inner support ring is typically split at the horizontal mid-line of the turbine and is engaged by radially inwardly dependent inner platform rails supporting the nozzle segments against aft axial movement.

The annular array of nozzle segments are sealed one to the other along adjoining circumferential edges by side seals. The side seals seal between the high pressure region radially inwardly of the inner platform, i.e., a region of compressor discharge air at high pressure, and the rotor rim cavity as well as the hot gases of combustion in the hot gas flow path which are at a lower pressure. In a typical gas turbine, the greatest pressure drop in the turbine occurs between this first stage nozzle cooling air supply plenum and the forward rotor rim cavity including the hot gas path outboard of the rim cavity. A seal is also typically provided at the sliding interface between each nozzle rail and the inner support ring to contain this pressure differential. A chordal land seal is conventionally used to seal between these components and comprises a narrow raised land of material integral to the aft face of each rail. The ends of the seal lands between adjacent nozzles align radially forming a full annular land bearing on the forward face of the support ring. The sealing efficiency of nozzle chordal land seals is limited, however, by 1) an uneven sealing load along the seal land length caused by circumferential torque generated by the nozzle; 2) lack of flatness of the seal lands and support ring caused by thermal distortion of the nozzle and support ring as well as seal surface variations resulting from manufacturing limitations; and 3) a lack of smooth surface finish on the chordal seal lands and support ring resulting from surface galling and corrosion during operation.

A number of different types of sealing systems have been proposed to improve the sealing efficiency and hence turbine efficiency between the region of high pressure compressor discharge air and the rotor rim cavity. For example, U.S. Pat. Nos. 6,641,144; 6,572,331; 6,637,753; and 6,637,751 disclose various seals supplemental to the chordal seals for this region of the turbine.

In accordance with a preferred aspect of the present invention, there is provided a seal assembly which affords additional reduction in cooling air leakage across the nozzle chordal land seal thereby improving overall turbine efficiency. More particularly, a barrier to the high pressure compressor discharge air is created between the inner retainer segments and the forward face of the nozzle inner rail. Preferably finger seal assemblies form a full annulus and seal along the full circumference of the forward face of the nozzle inner rails. When combined with the inter-segment seals at the first stage inner rail, i.e., the chordal seals, the finger seals form an intermediate pressure plenum upstream of the nozzle aft chordal land seals and which seals in series dramatically increase sealing efficiency and reduce leakage.

In a preferred embodiment according to the present invention, there is provided a turbine comprising a turbine nozzle segment having at least one stator vane and including an inner platform rail; a turbine nozzle inner support ring in part in axial registration with the rail on one side thereof; an inner retainer segment secured to the inner support ring and in part in axially spaced registration relative to the rail on an axial side of the rail opposite from the support ring; and a seal assembly extending between the inner retainer segment and the rail, the seal assembly including a plurality of seal fingers secured to the inner retainer segment and in engagement with the rail.

In a further preferred embodiment according to the present invention, there is provided a turbine comprising a plurality of nozzle segments arranged about a turbine axis with each segment having at least one stator vane and an inner platform carrying an inner platform rail; inner nozzle support rings in part in spaced axial registration with the rails and on one axial side of the rails; a plurality of inner retainer segments secured to the inner supporting rings and in part in axial spaced registration relative to the rails on an axial side of the rails from the support rings; and a seal assembly between the inner retainer segments and the rails, the seal assembly including a plurality of circumferentially spaced inner retainer seals each including a plurality of circumferentially spaced seal fingers for sealing engagement with the rails.

In still another preferred embodiment in accordance with the present invention, there is provided a method of installing a seal assembly in a turbine having a plurality of nozzle segments arranged about a turbine axis with each segment having at least one stator vane and an inner platform carrying an inner platform rail and inner nozzle support rings in part in spaced axial registration with the rails and on one axial side of the rails for sealing between high and low pressure regions on opposite sides of the rails, comprising the steps of providing a plurality of inner retainer segments secured to the inner supporting rings and in part in axial spaced registration relative to the rails on an axial side of the rails opposite from the support rings; securing a plurality of circumferentially spaced inner retainer seals each including a plurality of circumferentially spaced seal fingers to the inner retainer segments; and securing the inner retainer segments with the seals secured thereto to the support rings with the seals extending from the segments into sealing engagement with the rails on the axially opposite sides thereof from the support rings.

DETAILED DESCRIPTION OF THE INVENTION

Figure 1:
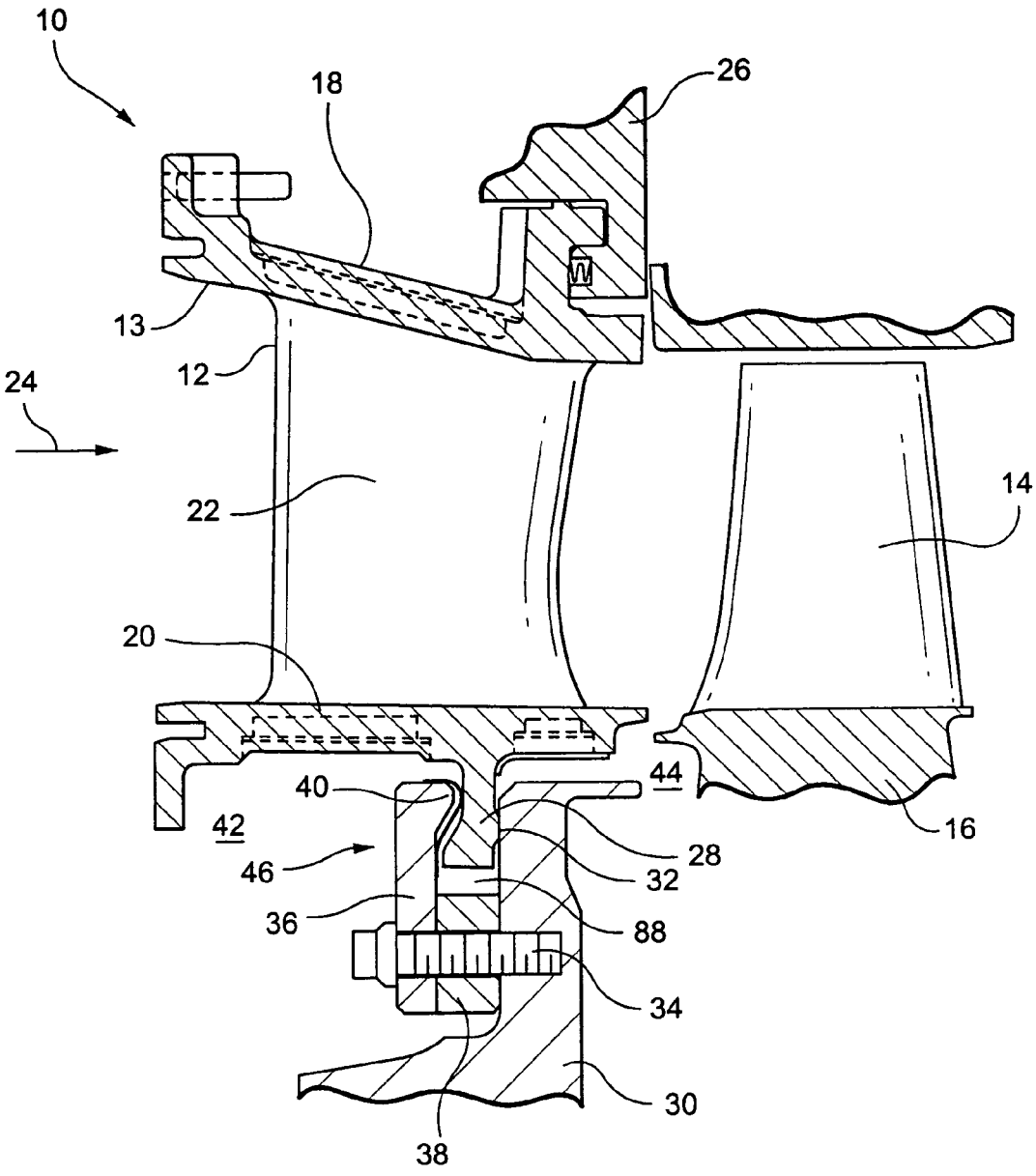
FIG. 1 is a fragmentary cross-sectional view illustrating a first stage nozzle with a seal assembly in accordance with a preferred aspect of the present invention.

Referring now to the drawings, particularly to FIG. 1, there is illustrated a portion of a turbine, generally designated 10, including a first stage nozzle 12 and first stage buckets 14 forming part of a rotor 16. The nozzle 12 includes an outer band or platform 18, and an inner band or platform 20. The nozzle 12 is formed of a plurality of nozzle segments 13 each having an outer and inner band 18 and 20, respectively, with one or more vanes 22 extending therebetween. As is well known, the nozzle vanes 22 as well as the buckets 14 extend in the hot gas path of the turbine, the hot gas path having a flow direction designated by the arrow 24 in FIG. 1. The vanes 22 and buckets 14 are arranged in annular arrays about an axis of the turbine. The outer platform 18 of each nozzle segment is secured to an outer retaining ring 26. Each of the nozzle segments includes a radially inwardly directed inner platform rail 28, the aft face of which bears against an inner support ring 30 precluding axial movement in an aft direction. Particularly, and as conventional, the aft face of each rail 28 has an arcuate projecting land 32 for sealing against the forward axial face of the inner support ring 30, the rails forming an annular chordal seal about the upper and lower halves of the support ring 30.

Also secured to the inner support rail 30, by a plurality of circumferentially spaced bolts or pins 34, are a plurality of arcuate inner retainer segments 36. Segments 36 are axially spaced from the support rails 34 by a plurality of arcuate inner retainer spacers 38. The radial outer margins 40 of the inner retainer segments 36 are axially enlarged in a direction toward the inner support rings 30 but are spaced from the rails 28 extending between the retainer segments 36 and support rings 30. In an exemplary embodiment of the present invention, there are 32 nozzle segments forming an annular array of nozzle vanes 22 about the turbine axis and preferably six each of the inner retainer segments 36 and inner retainer spacers 38, each of the segments 36 and the spacers 38 being disposed in an annular array about the axis of the turbine. As will be appreciated, the region 42 forwardly of the inner retainer segments 36 receives cooling air, i.e., compressor discharge air under high pressure, and it is essential to seal the high pressure region 42 from the lower pressure region 44 adjacent the forward rotor rim cavity and also the hot gas path outboard of the rim cavity.

Each of the chordal land seals 32 typically comprises a narrow raised arcuate land integral to the face of the rail 28 forming with adjacent nozzles a complete circumferential array of chordal land seals bearing against the support rings 30. While chordal land seals 32 have been effective, they are also limited by a potential for uneven sealing caused by circumferential torque generated by the nozzle, a lack of flatness of the sealing lands and forward face of the support ring 30 caused by thermal distortion as well as a lack of smooth surface finishes on the sealing lands and support ring resulting from manufacture and/or surface galling and corrosion during operation. Consequently, there is a need to provide additional sealing between the high and low pressure regions 42 and 44, respectively. This additional sealing has been addressed previously, for example, see the U.S. Patents referenced above. However, those supplementary chordal seals did not provide a continuous sealing surface along the nozzle inner rail and lacked sufficient control over the contact between seals and the opposing surface to prevent or minimize the formation of gaps therebetween.

Figure 2:
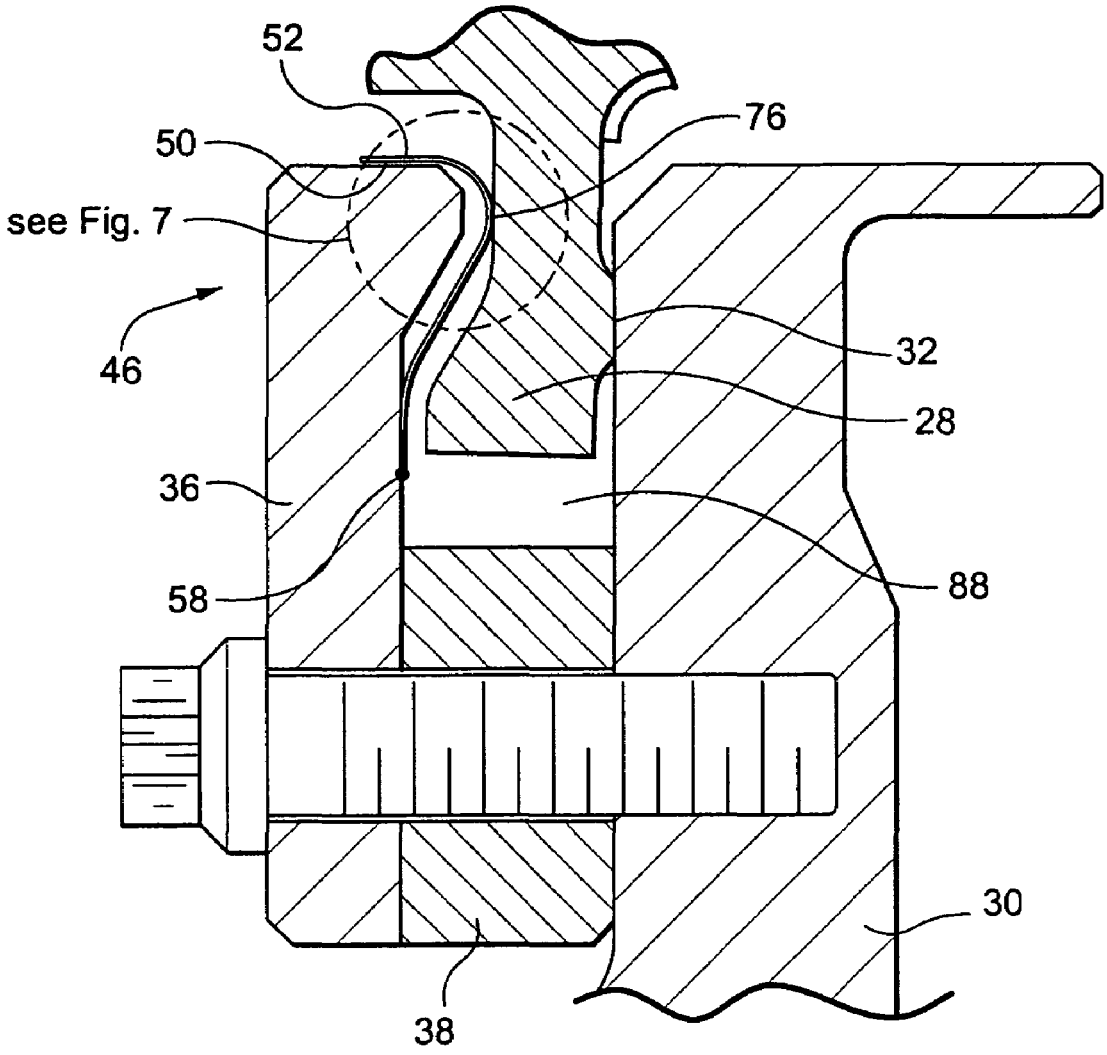
FIG. 2 is an enlarged fragmentary cross-sectional view of the seal assembly.
Figure 3:
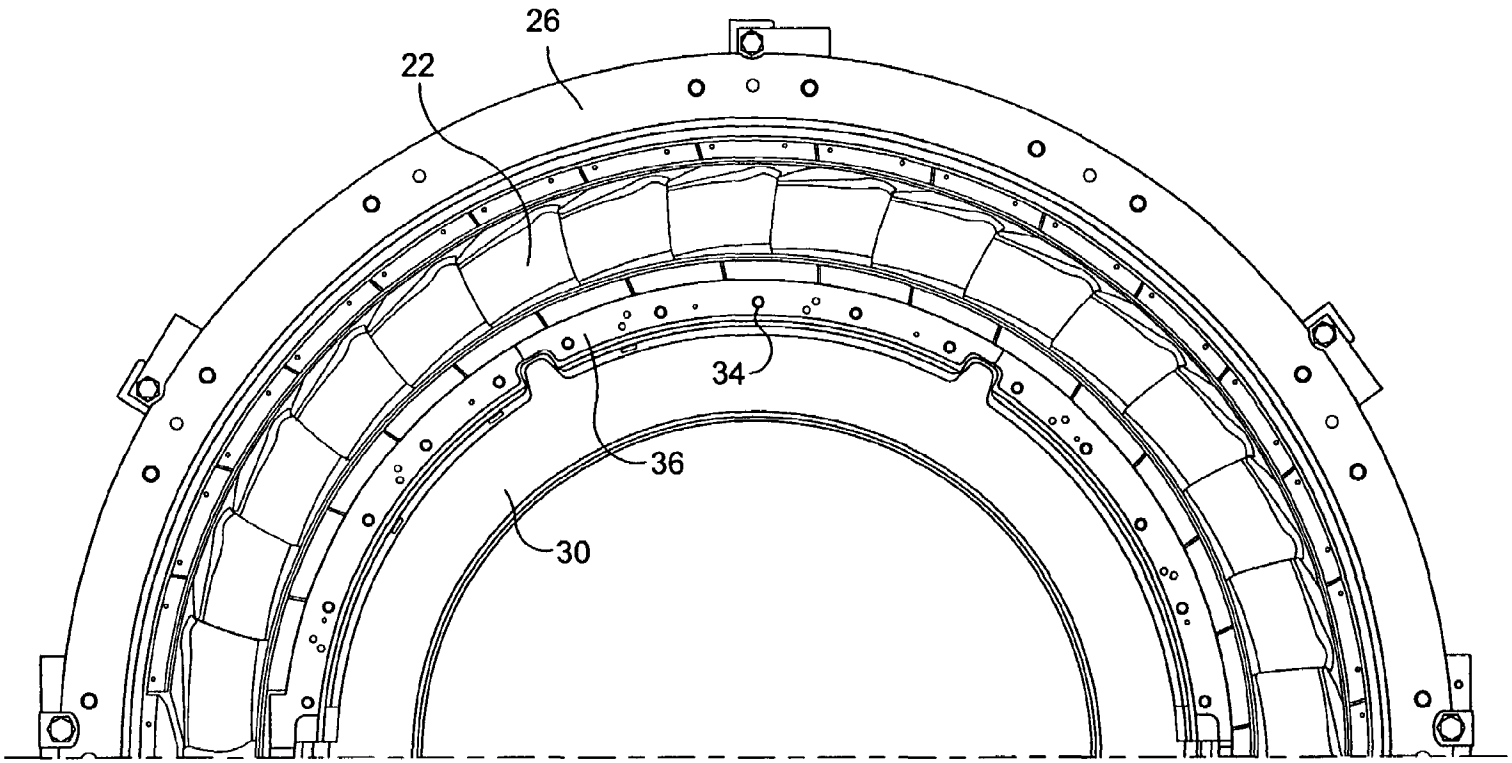
FIG. 3 is an axial view of the upper half of the first stage nozzle assembly looking aft.
Figure 4:
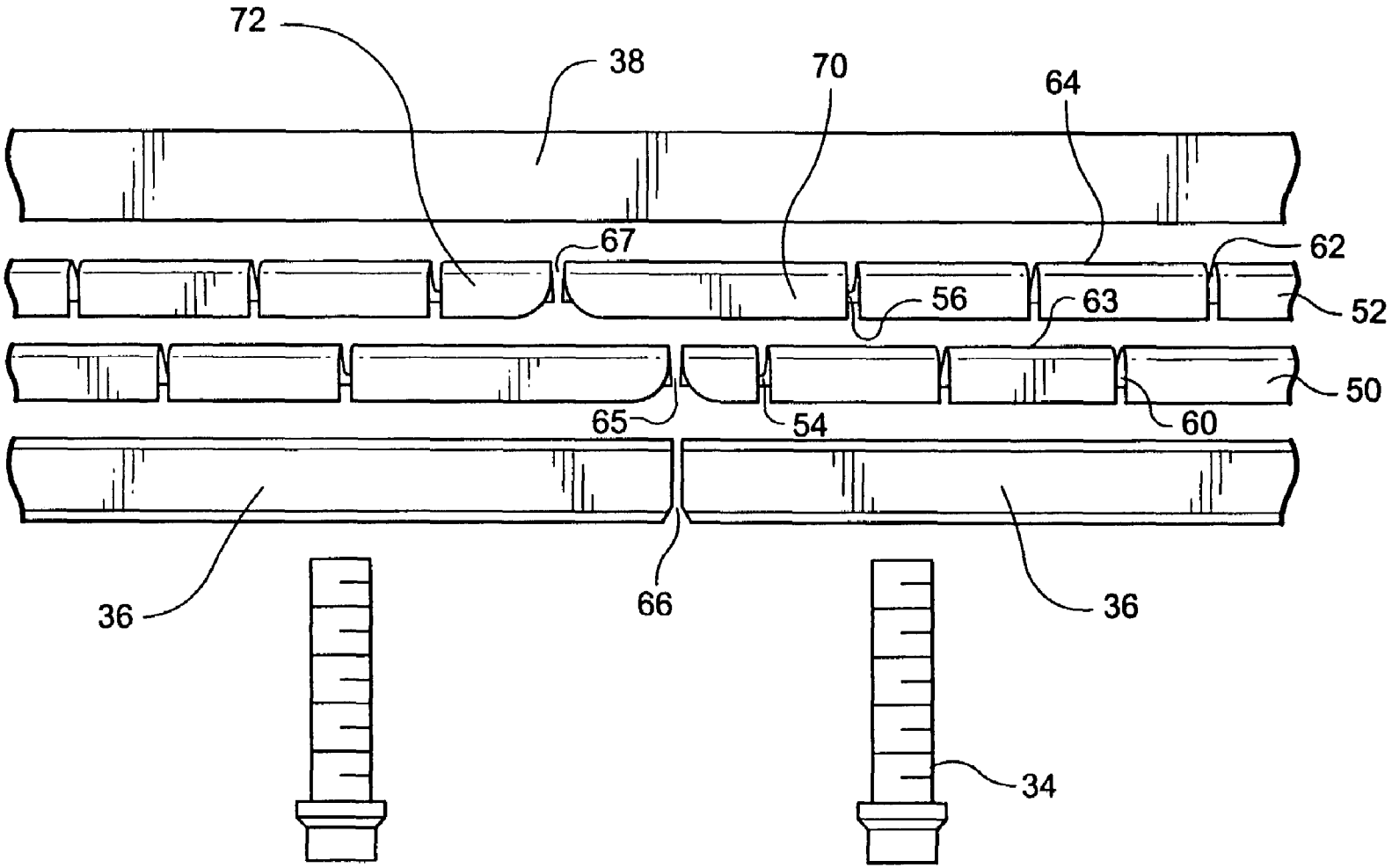
FIG. 4 is a schematic illustration of the seal assembly hereof.
Figure 7:
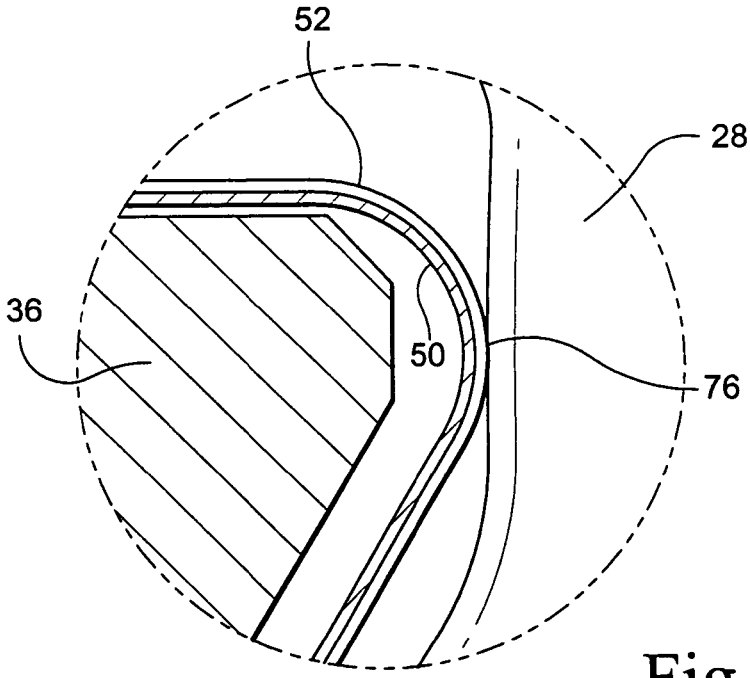
FIG. 7 is an enlarged cross-sectional view as viewed in FIG. 2.
Figure 8:
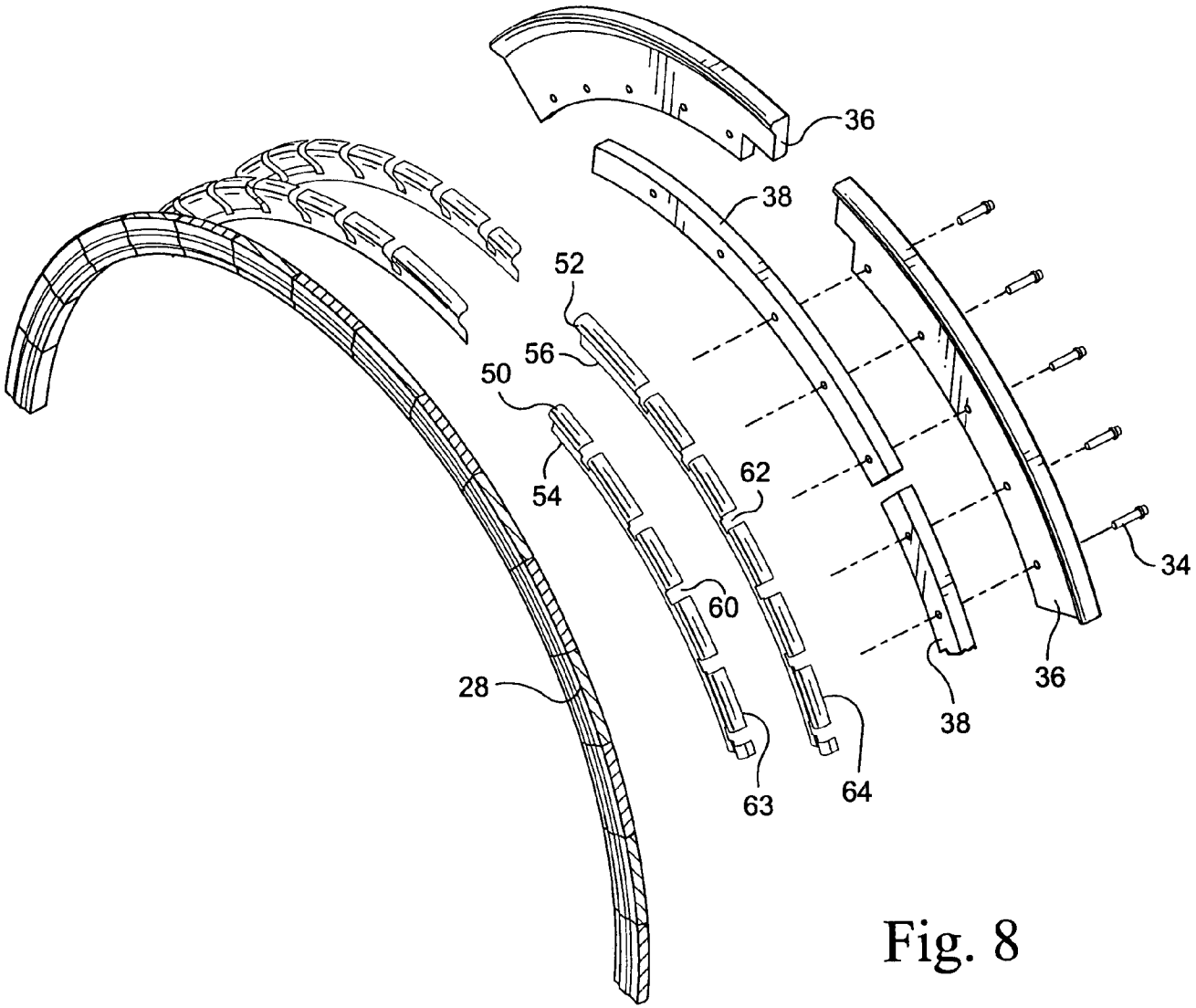
FIG. 8 is a partial perspective view of various parts forming the seal assembly hereof.

The seal assemblies hereof, generally designated 46, are best illustrated in FIGS. 2, 4 and 7. Particularly, seal assemblies 46 seal between the inner retainer segments 36 and the forward axial face of the rails 28 of the nozzle segments 13. Each seal assembly 46 includes two layers 50 and 52 of formed sheet metal stock placed back-to-back, i.e., in conformance with one another. Both layers 50 and 52 are in an arcuate configuration have lengths corresponding to the lengths of the inner retainer segments 36. Each of the layers 50 and 52 of the arcuate seals of the seal assembly 46 are shaped to follow general surface configuration between the downstream axial face of the inner retainer segments 36 and the axial upstream faces of the rails 28 of the nozzle segments 13 as best illustrated in FIG. 2. Each layer 50 and 52 has a base 54 and 56, respectively, which is seam welded at 58 (FIG. 2) to the rear face of the associated inner retainer segment 36. Both layers 50 and 52 extend in a radial outward and axially rearward direction toward the forward faces of the rails and then extend axially forwardly to overlay the radial outer face of the inner retainer segment 36. Each layer 50 and 52 has multiple radial relief cuts 60 and 62, respectively (FIGS. 4 and 8), along the arc length of the layers to form individual seal fingers 63 and 64, respectively. As illustrated in FIG. 4, the cuts 60 and 62 in the layers 50 and 52, respectively, are offset in a circumferential direction by one finger pitch such that the cuts of one seal layer do not axially align with the cuts of the other seal layer. Additionally, as illustrated in FIG. 4, the gap 65 between adjacent ends of one layer 50 lies in axial registration with the gap 66 between adjacent ends of the inner retainer spacers 36. However, the gap 65 between the ends of seal layers 50 are bridged by a circumferentially enlarged finger 70 of the layer 52, thereby shifting in a circumferential direction the gap 67 between adjacent ends of seal finger layer 62 out of alignment with gaps 65 and 66. Also, the abutting end faces of the inner retainer spacers 38 are positioned in the middle of the arc of each inner retainer segment 36. In this manner, any straight-through leakage path or gap is eliminated.

By using multiple fingers 62 and 64 with each finger seal layer 50 and 52, respectively, accommodation of surface variations in the line of sealing contact at 76 (FIGS. 2 and 7) is obtained. Thus, variations such as manufacturing tolerances, uneven circumferential loading of the nozzle vane which tends to rock the nozzle slightly, lack of flatness of the nozzle in a rail caused by thermal distortion and seal surface irregularities and a lack of a smooth surface finish on the finger seals and inner rail seal lands resulting from surface galling or corrosion during operation are accommodated. Also, by attaching the seal layers 50 and 52 to the inner retainer segments 36 with a bias toward the axial forward faces of rails 28, more precise gap control between finger seals is provided. This also facilitates handling of delicate seal components and reduces problems and complications during turbine assembly and maintenance.

Figure 5:
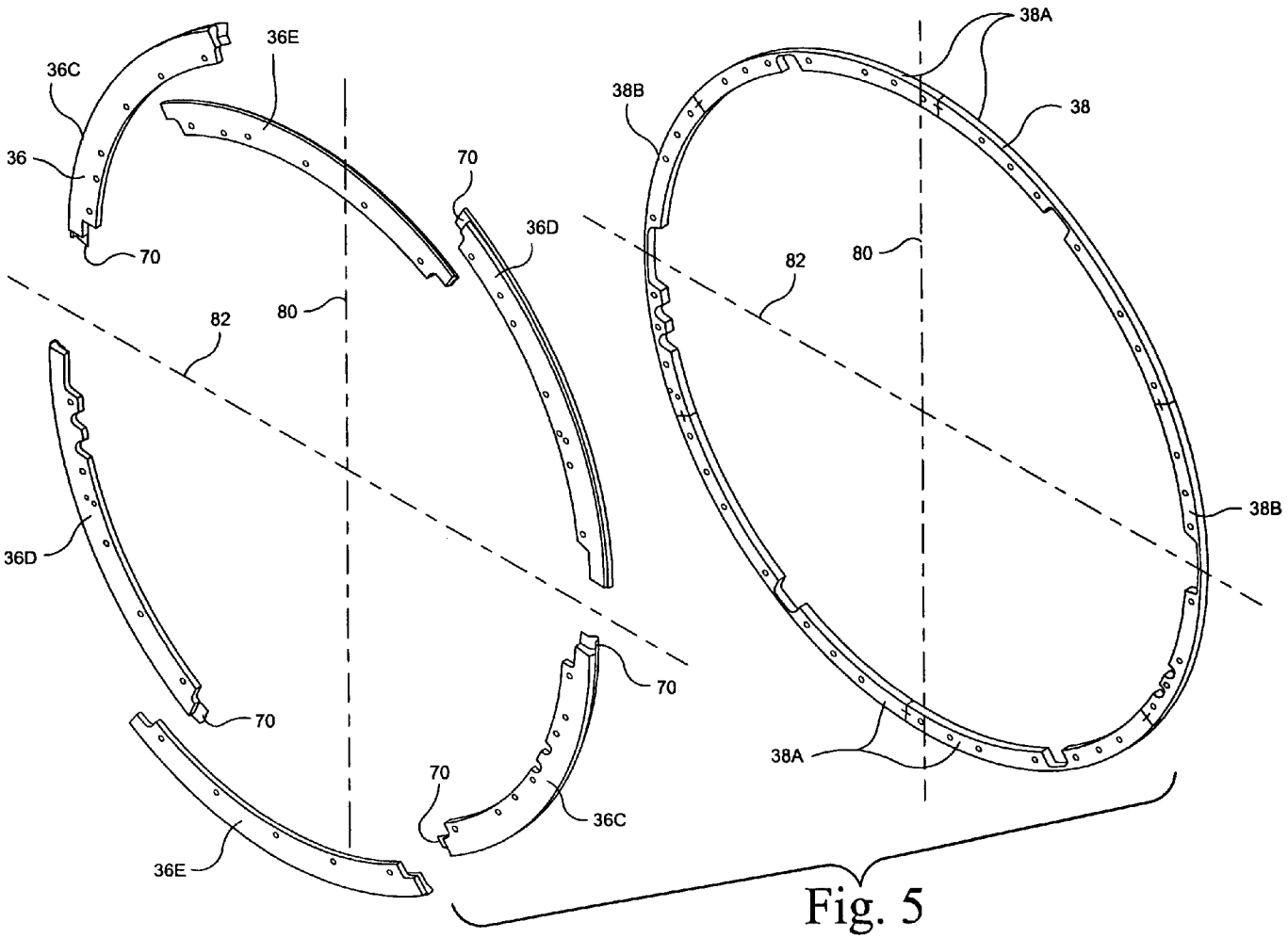
FIG. 5 is a perspective view illustrating the assembly of the inner retainer segments and the inner retainer spacers.

Referring now to FIG. 5, because of the overlapping nature of the end finger seals, the inner retainer spacers 38 and inner retainer segments 36 must be installed in sequence. The sequence of installation is designated by the letters A through E following the corresponding reference numerals and the removal sequence is designated similarly but in the reverse order. As illustrated in FIG. 5, the inner retainer spacers 38 are preferably 6 in number, each extending 60°. The spacers 38A have end faces along a vertical center line 80 are first aligned with the inner support ring 30. Then the spacers 38B are then aligned with the support ring 30. It will be seen that the horizontal midline or axis 82 bisects the spacers 38B. Next, the segments 36 mounting the seal layers 50 and 52 along their aft axial faces are applied to the spacers 38. Particularly, the segments 36C are first applied to the spacers followed by the segments 36D. It will be appreciated that the segments 36C have enlarged finger seals 70 which extend circumferentially beyond the end face of the associated segment. Additionally, the next segments 36D have a short finger segment 72 (FIG. 4) inset from the end face. Thus, by applying the segments 36C and 36D in sequence, the projecting end finger seals 70 of segments 36C are overlapped by the ends of segments 36D. Next the segments 36E are applied. Each of the segments 36E has a short finger seal 72 at opposite ends. Thus, the longer finger seals 70 of segments 36C and 36D are overlapped by projecting ends of segments 36E. It will be appreciated that the seal layers 50 and 52 are initially biased against the rails 28 to produce sealing contact without and seal-through gaps.

Figure 6:
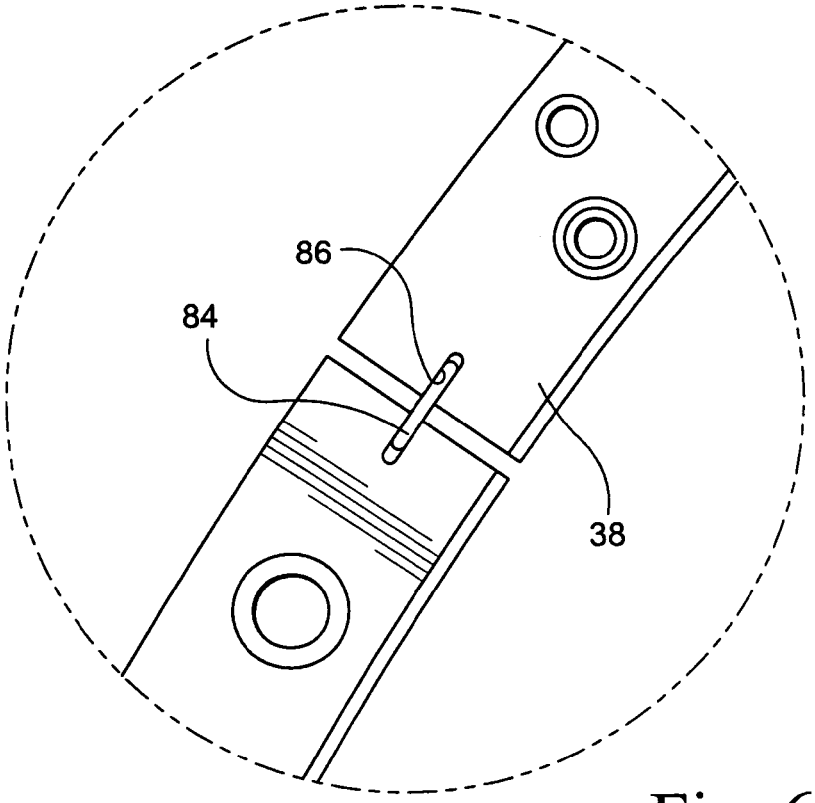
FIG. 6 is an enlarged perspective view illustrating a seal at end faces of the inner retainer spacers.

As illustrated in FIG. 6, the end gaps between the spacers 38 are provided with seals 84. Preferably, a small cloth seal 84 is employed in slots 86 milled into the ends of the spacers 38. These cloth seals 84 minimize or preclude the flow of air from the high pressure region 42 into an intermediate chamber 88 (FIG. 2). Thus, it will be appreciated that the high pressure and low pressure regions 42 and 44 respectively are segregated one from the other by the finger seals engaging the rails 28 and by the chordal land seals 32. Both of these seals are separated by the chamber 88. Thus, the finger seal system hereof forms an intermediate pressure plenum or chamber upstream of the chordal land seal. The use of these two seals in series with an intermediate pressure chamber 88 therebetween increases sealing efficiency, reduces leakage and improves overall turbine efficiency.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A turbine comprising:

a turbine nozzle segment having at least one stator vane and including an inner platform rail;

a turbine nozzle inner support ring in part in axial registration with said rail on one side thereof;

an inner retainer segment secured to said inner support ring and in part in axially spaced registration relative to said rail on an axial side of said rail opposite from said support ring; and a seal assembly extending between said inner retainer segment and said rail, said seal assembly including a plurality of seal fingers secured to said inner retainer segment and in engagement with said rail, said seal assembly including first and second sets of circumferentially adjacent seal fingers overlying one another, said first set of seal fingers having at least one gap between circumferentially adjacent fingers thereof and said second set of seal fingers having at least one gap between circumferentially adjacent fingers thereof, said first and second sets of seal fingers being staggered in a circumferential direction relative to one another with a finger of said first set of fingers overlying the one gap between the circumferentially adjacent fingers of said second set thereof.

2. A turbine according to claim 1 wherein said seal fingers are biased into engagement with said rail.

3. A turbine according to claim 1 wherein said seal fingers have a common base secured to said inner retainer segment.

4. A turbine according to claim 1 wherein said first and second sets of fingers each have a common base secured to said inner retainer segment with the fingers thereof projecting from said bases generally radially outwardly and with one set of fingers engaging said rail.

5. A turbine according to claim 4 wherein said rail and said inner support ring include a chordal seal therebetween, an inner retainer spacer between said ring and said inner retainer segment, said seal fingers between said inner retainer segment and said rail, said chordal seal and said spacer defining an intermediate pressure plenum therebetween.

6. A turbine comprising:

a plurality of nozzle segments arranged about a turbine axis with each segment having at least one stator vane and an inner platform carrying an inner platform rail;

inner nozzle support rings in part in spaced axial registration with said rails and on one axial side of said rails;

a plurality of inner retainer segments secured to said inner supporting rings and in part in axial spaced registration relative to said rails on an axial side of said rails from said support rings; and a seal assembly between said inner retainer segments and said rails, said seal assembly including a plurality of circumferentially spaced inner retainer seals each including a plurality of circumferentially spaced seal fingers for sealing engagement with said rails, each said retainer seal including first and second sets of circumferentially adjacent seal fingers overlying one another and secured to each of said inner retainer segments, said first and second sets of fingers of each inner retainer seal having at least one gap between circumferentially adjacent fingers and said second set of seal fingers having at least one gap between circumferentially adjacent fingers thereof, said first and second sets of seal fingers being staggered in a circumferential direction relative to one another with a finger of said first set of fingers overlying the one gap between the circumferentially adjacent fingers of said second set thereof.

7. A turbine according to claim 6 wherein said first and second sets of fingers each have a common base secured to said inner retainer segment with the fingers thereof projecting from said bases generally radially outwardly and with one set thereof engaging said rails.

8. A turbine according to claim 7 including a plurality of inner retainer spacers between said rings and said inner retainer segments, said spacers being equal in number to the number of said inner retainer segments with end gaps between circumferentially adjacent end faces of the inner retainer spacers being misaligned with end gaps between said inner retainer segments.

9. A turbine according to claim 8 including a seal between the end faces of circumferentially adjacent inner retainer spacers.

10. A turbine according to claim 8 including chordal seals between said rails and said support rings, said seal assembly, said chordal seals, said spacers, said inner retainer ring segments and said rails defining an intermediate pressure plenum between said chordal seals and said seal assembly.

11. A method of installing a seal assembly in a turbine having a plurality of nozzle segments arranged about a turbine axis with each segment having at least one stator vane and an inner platform carrying an inner platform rail and inner nozzle support rings in part in spaced axial registration with said rails and on one axial side of said rails for sealing between high and low pressure regions on opposite sides of said rails, comprising the steps of:

providing a plurality of inner retainer segments secured to said inner supporting rings and in part in axial spaced registration relative to said rails on an axial side of said rails opposite from said support rings;

securing a plurality of circumferentially spaced inner retainer seals each including a plurality of circumferentially spaced seal fingers to said inner retainer segments;

securing said inner retainer segments with said seals secured thereto to said support rings with said seals extending from said segments into sealing engagement with said rails on said axially opposite sides thereof from said support rings;

providing first and second overlapping sets of said inner retainer seals with each set of seals having at least one gap between circumferentially adjacent fingers thereof, and staggering said first; and second sets of seals in a circumferential direction relative to one another enabling a finger of said first set of seals to overlie a gap between adjacent fingers of said second set of seals.

12. A method according to claim 11 wherein said first and second sets of seals each have a common base, and including securing said common bases to said inner retainer segments with said seal fingers thereof projecting into biased engagement with said rails.

13. A method according to claim 11 wherein at least a pair of said first sets of seals have seal fingers extending beyond end faces of a corresponding pair of inner retainer segments and securing said pair of said segments to said support rings and subsequently securing remaining segments to said support rings with portions thereof overlapping said extending seal fingers of said first set of seals.

* * * * *

UNITED STATES PATENT AND TRADEMARK OFFICE

CERTIFICATE OF CORRECTION

PATENT NO. : 7,094,026 B2
APPLICATION NO. : 10/834116
DATED : August 22, 2006
INVENTOR(S) : Coign et al.

It is certified that error appears in the above-identified patent and that said Letters Patent is hereby corrected as shown below:

Column 5, line 34, delete “without and” and insert --without any--.

Signed and Sealed this

Nineteenth Day of December, 2006

JON W. DUDAS
*Director of the United States Patent and Trademark Office*